US012221842B2

(12) United States Patent
Painter

(10) Patent No.: US 12,221,842 B2
(45) Date of Patent: Feb. 11, 2025

(54) WELLBORE ANNULUS PRESSURE MANAGEMENT

(71) Applicant: Chevron U.S.A. Inc., San Ramon, CA (US)

(72) Inventor: Jay Patrick Painter, League City, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/500,719

(22) Filed: Nov. 2, 2023

(65) Prior Publication Data

US 2024/0151114 A1 May 9, 2024

Related U.S. Application Data

(60) Provisional application No. 63/422,271, filed on Nov. 3, 2022.

(51) Int. Cl.
*E21B 21/08* (2006.01)
*E21B 33/04* (2006.01)

(52) U.S. Cl.
CPC ..... *E21B 21/08* (2013.01); *E21B 33/04* (2013.01)

(58) Field of Classification Search
CPC ..... E21B 33/04; E21B 21/08
See application file for complete search history.

(56) References Cited

U.S. PATENT DOCUMENTS 7,584,798 B2 * 9/2009 Dallas ..... E21B 33/068 166/85.4
8,316,946 B2 * 11/2012 June ..... E21B 33/043 166/344
10,480,271 B2 * 11/2019 Al-Badran ..... E21B 33/02
11,274,503 B2 * 3/2022 Dokhon ..... E21B 33/138
11,634,954 B2 * 4/2023 Jordan ..... E21B 21/08 166/285
11,773,678 B2 * 10/2023 Bartlett ..... E21B 33/0355 166/344
2004/0154800 A1 * 8/2004 Jack ..... E21B 33/068 166/305.1
2004/0231835 A1 * 11/2004 Thai ..... E21B 33/047 166/208
2021/0348468 A1 * 11/2021 Mukhlifi ..... E21B 33/047

FOREIGN PATENT DOCUMENTS

EP 3892816 A1 * 10/2021 ..... E21B 21/08
WO WO-2015147806 A1 * 10/2015 ..... E21B 21/08

* cited by examiner

*Primary Examiner* — Aaron L Lembo
(74) *Attorney, Agent, or Firm* — Smith & Woldesenbet Law Group, PLLC

(57) ABSTRACT

A wellhead housing of a wellhead assembly can include a body having a top end, a bottom end, and a cavity that traverses its length between the top end and the bottom end. The wellhead housing can also include a main channel that traverses the body from the cavity at a distal end of the main channel to an outer perimeter of the body at a proximal end of the main channel, where the proximal end of the main channel is located closer to the top end of the body compared to the distal end of the main channel, and where the distal end of the main channel is located closer to the bottom end of the body compared to the proximal end of the main channel.

19 Claims, 9 Drawing Sheets

WELLBORE ANNULUS PRESSURE MANAGEMENT

CROSS-REFERENCE TO RELATED APPLICATIONS

This application claims priority under 35 U.S.C. § 119 to U.S. Provisional Patent Application Ser. No. 63/422,271, titled "WELLBORE ANNULUS PRESSURE MANAGEMENT" and filed on Nov. 3, 2022, the entire contents of which are hereby incorporated herein by reference.

TECHNICAL FIELD

The present application is related to wellbore operations and, more particularly, to wellbore annulus pressure management.

BACKGROUND

In subterranean field operations (e.g., production), when liquid fills a substantial volume of the annulus (the gap between the inner most casing string and the tubing string in the wellbore), high pressure can develop quickly, leading to potentially hazardous situations. Because liquids are not very compressible, minimal changes in volume in the annulus can lead to significant pressure increases. Pressure can build in the annulus from any of a number of causes, including but not limited to a pressure spike in an adjacent wellbore in communication with the current wellbore, a change (e.g., increase) in temperature, development of bacteria, and a change in volume in other casing strings.

SUMMARY

In general, in one aspect, the disclosure relates to a wellhead housing of a wellhead assembly. The wellhead housing can include a body having a top end, a bottom end, and a cavity that traverses its length between the top end and the bottom end. The wellhead housing can also include a main channel that traverses the body, where the main channel has a proximal end that is located closer to the top end of the body compared to a distal end of the main channel, and where the distal end of the main channel is located closer to the bottom end of the body compared to the proximal end of the main channel.

In another aspect, the disclosure relates to a system for removing liquid from an annulus in a wellbore. The system can include a wellhead housing, which can include a wellhead housing body having a top end, a bottom end, and a wellhead housing cavity that traverses its length between the top end and the bottom end, where the annulus is within the wellhead housing cavity. The wellhead housing of the system can also include a first main channel segment of a main channel, where the first main channel segment traverses the wellhead housing body, where the first main channel segment has a proximal end at an outer perimeter of the wellhead housing body and a distal end at an inner perimeter of the wellhead housing body, where the proximal end of the first main channel segment is located closer to the top end of the wellhead housing body compared to the distal end of the first main channel segment, and where the distal end of the first main channel segment is located closer to the bottom end of the wellhead housing body compared to the proximal end of the first main channel segment. The system can also include an additional wellhead component disposed within the wellhead housing cavity of the wellhead housing. The additional wellhead component of the system can include an additional wellhead component body having a top end, a bottom end, and an additional wellhead housing cavity that traverses its length between the top end and the bottom end, where the annulus is within the additional wellhead housing cavity. The additional wellhead component of the system can also include a second main channel segment of the main channel, where the second main channel segment traverses the additional wellhead housing body, where the second main channel segment has a distal end at the annulus and a proximal end at an outer perimeter of the additional wellhead housing body, where the proximal end of the second main channel segment is located closer to the top end of the additional wellhead housing body compared to the distal end of the second main channel segment, where the distal end of the second main channel segment is located closer to the bottom end of the additional wellhead housing body compared to the proximal end of the second main channel segment, and where the proximal end of the second main channel segment merges and is continuous with the distal end of the first main channel segment. The system can further include tubing disposed in the first main channel segment and the second main channel segment, where a distal end of the tubing is in the annulus, and where a proximal end of the tubing is accessible at a surface where field operations are conducted.

In yet another aspect, the disclosure relates to a method for removing liquid from an annulus in a wellbore. The method can include inserting tubing through a main channel in a wellhead housing, where a distal end of the tubing is disposed in the liquid in the annulus, and where the main channel forms an obtuse angle with an outer surface of the wellhead housing. The method can also include removing the liquid from the annulus through the tubing.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1A:
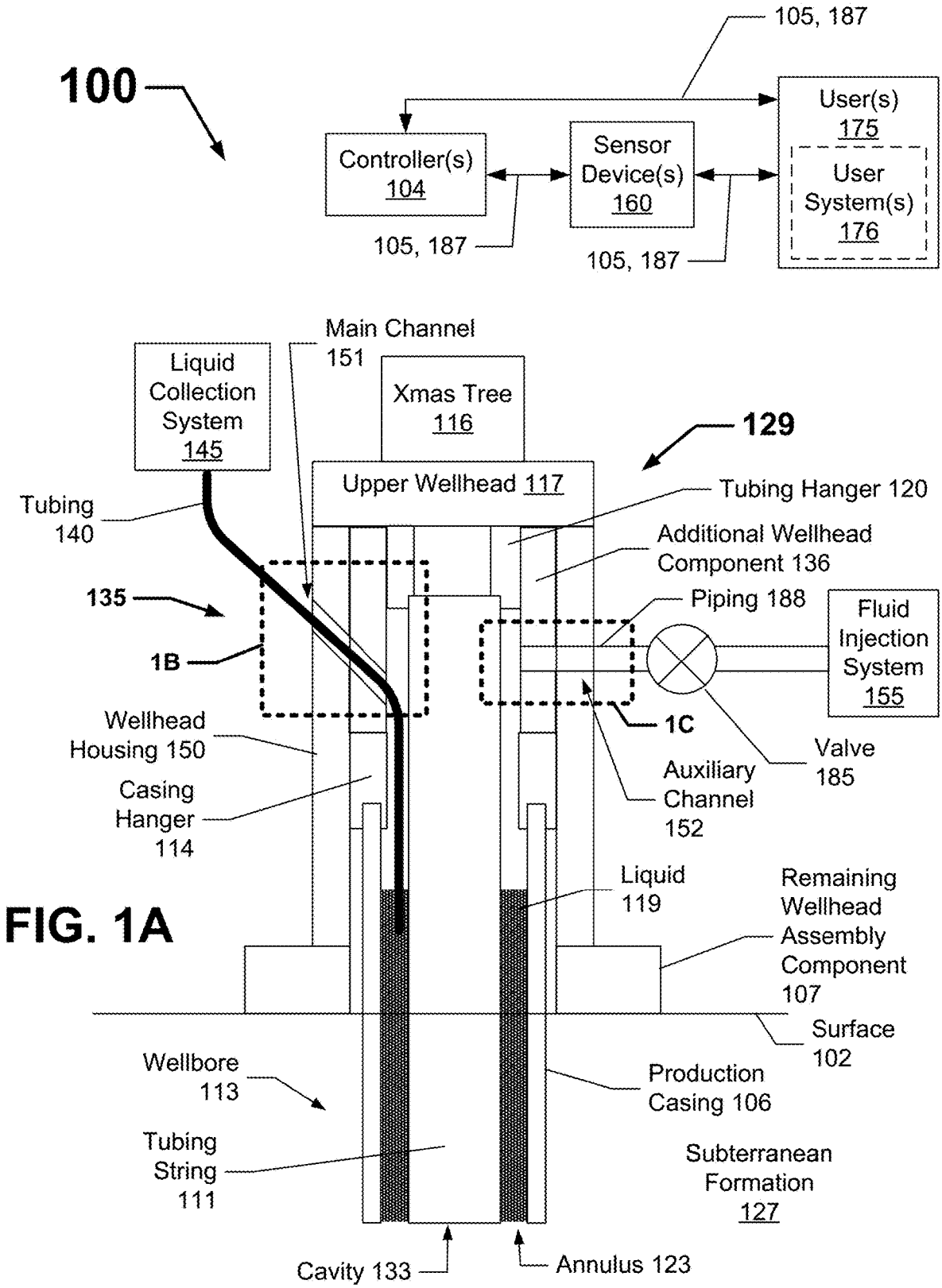
FIGS. 1A through 1C show a system that includes a wellbore annulus pressure management system according to certain example embodiments.

The example embodiments discussed herein are directed to systems, methods, and devices for wellbore annulus pressure management. Wellbores for which example embodiments are used can be drilled and completed to extract a subterranean resource. Examples of a subterranean resource can include, but are not limited to, natural gas, oil, and water. Wellbores for which example embodiments are used for managing wellbore annulus pressure can be land-based or subsea. Example embodiments for managing wellbore annulus pressure can be rated for use in hazardous environments.

Example embodiments can include multiple components that are described herein, where a component can be made from a single piece (as from a mold or an extrusion). When a component (or portion thereof) of an example embodiment for wellbore annulus pressure management is made from a single piece, the single piece can be cut out, bent, stamped, and/or otherwise shaped to create certain features, elements, or other portions of the component. Alternatively, a component (or portion thereof) of an example embodiment for wellbore annulus pressure management can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, abut against, fasten, and/or perform other functions aside from merely coupling. In addition, each component and/or feature described herein (including each component of an example wellbore annulus pressure management system) can be made of one or more of a number of suitable materials, including but not limited to metal (e.g., stainless steel), ceramic, rubber, glass, and plastic.

A coupling feature (including a complementary coupling feature) as described herein can allow one or more components (e.g., a housing) and/or portions of an example embodiment for wellbore annulus pressure management to become mechanically coupled, directly or indirectly, to another portion of the example embodiment for wellbore annulus pressure management and/or a component of a larger system. A coupling feature can include, but is not limited to, a portion of mating threads, a hinge, an aperture, a recessed area, a protrusion, a slot, and a detent. One portion of an example coupling feature can be coupled to another portion of an example embodiment for wellbore annulus pressure management and/or a component of a larger system by the direct use of one or more coupling features.

In addition, or in the alternative, a portion of an example embodiment for wellbore annulus pressure management can be coupled to another portion of the example embodiment for wellbore annulus pressure management and/or a component of a larger system using one or more independent devices that interact with one or more coupling features disposed on a component of the example embodiment for wellbore annulus pressure management. Examples of such devices can include, but are not limited to, a fastening device (e.g., a bolt, a screw, a rivet), a pin, a hinge, an adapter, and a spring. One coupling feature described herein can be the same as, or different than, one or more other coupling features described herein. A complementary coupling feature as described herein can be a coupling feature that mechanically couples, directly or indirectly, with another coupling feature.

When used in certain systems (e.g., for certain subterranean field operations), example embodiments can be designed to help such systems comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Also, as discussed above, example embodiments for wellbore annulus pressure management can be used in hazardous environments, and so example embodiments for wellbore annulus pressure management can be designed to comply with industry standards that apply to hazardous environments.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments for wellbore annulus pressure management and related systems for wellbore field operations will be described more fully hereinafter with reference to the accompanying drawings, in which example embodiments for wellbore annulus pressure management and related systems for wellbore field operations are shown. Example embodiments for wellbore annulus pressure management and related systems for wellbore field operations may, however, be embodied in many different forms and should not be construed as limited to the example embodiments set forth herein. Rather, these example embodiments are provided so that this disclosure will be thorough and complete, and will fully convey the scope of wellbore annulus pressure management and related systems for wellbore field operations to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. This list of terms is not exclusive. Such terms are not meant to denote a preference or a particular orientation, and they are not meant to limit embodiments of wellbore annulus pressure management and related systems for wellbore field operations. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
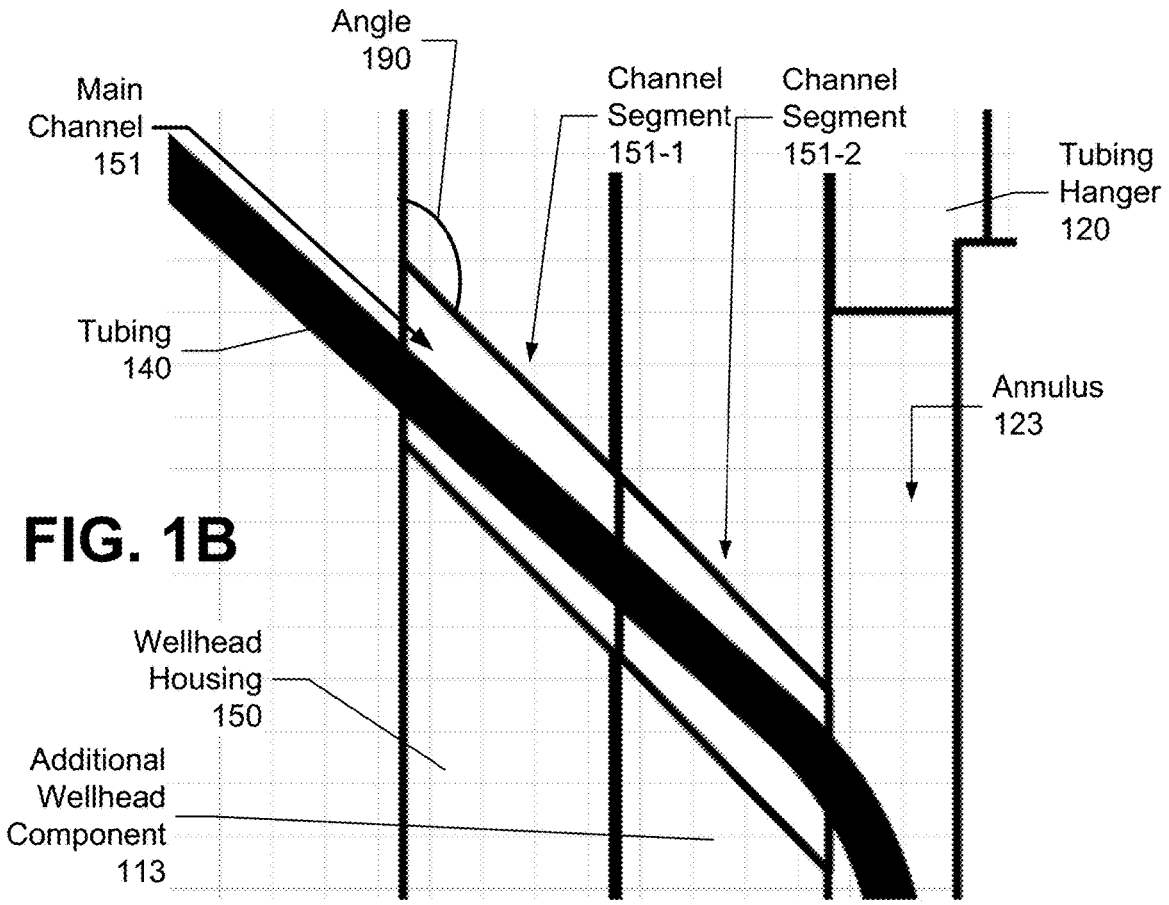
Figure 1C:
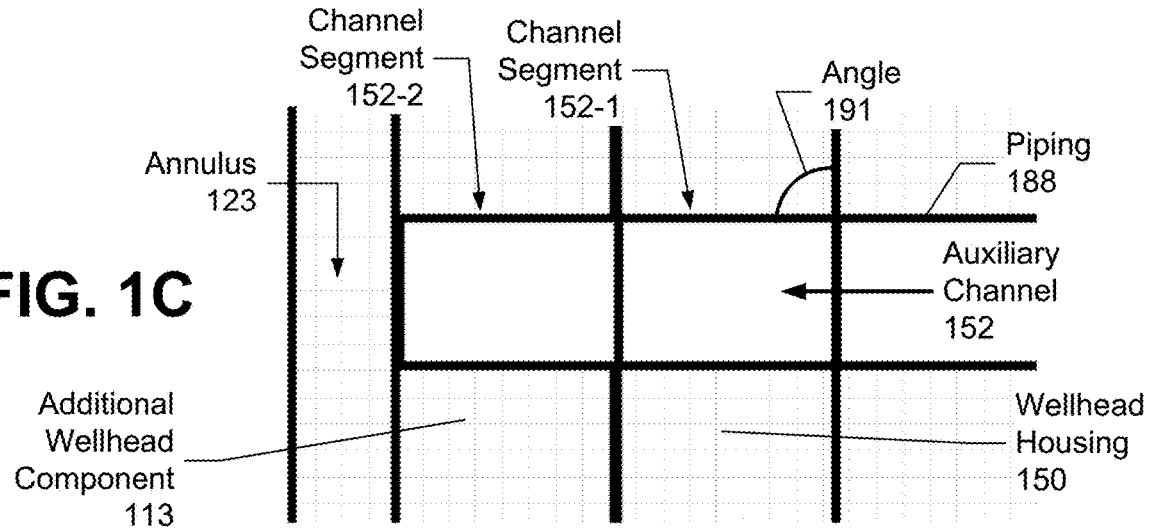

FIG. 1A through 1C show a system 100 that includes a wellbore annulus pressure management system 135 according to certain example embodiments. Specifically, FIG. 1A shows a semi-sectional view of the system 100. FIG. 1B shows a detailed view of the main channel 151 of the wellbore annulus pressure management system 135 of the system 100. FIG. 1C shows a detailed view of the auxiliary channel 152 of the wellbore annulus pressure management system 135 of the system 100. The system 100 includes multiple components. For example, as shown in FIG. 1A, the system 100 can include a wellhead assembly 129, a Xmas tree 116 mounted atop the wellhead assembly 129, a wellbore 113 in a subterranean formation 127, one or more controllers 104, one or more sensor devices 160, and one or more users 175, which can each include one or more user systems 176. The wellhead assembly 129 of the system 100 can include an upper wellhead 117, a tubing hanger 120, a casing hanger 114, a wellhead housing 150, the example wellbore annulus pressure management system 135, and one or more of a number of remaining wellhead assembly components 107.

The wellbore annulus pressure management system 135 includes multiple components. As shown in FIG. 1A, such components can include, but are not limited to, a fluid injection system 155, piping 188, a valve 185, a main channel 151, an auxiliary channel 152, tubing 140, and a liquid collection system 145. Examples of the remaining wellhead assembly components 107 can include, but are not limited to, additional valves, sensor devices 160, additional piping, a tubing spool, and additional casing hangers. The wellbore 113 has a production casing 106, inside of which is positioned a tubing string 111. The tubing string 111 has a cavity 133 that extends continuously along its length, and there is an annulus 123 between the tubing string 111 and the production casing 106 that extends continuously along its length. One or more liquids 119 fill some amount of the annulus 123. As discussed above, when there is too much liquid 119 in the annulus 123, changes in pressure within the annulus 123 can be rapidly and dangerously translated through the liquid 119.

The components shown in the system 100 of FIG. 1 are not exhaustive, and in some embodiments, one or more of the components shown in FIG. 1 may not be included in a wellhead assembly 129 in which an example wellbore annulus pressure management system 135 can be used. Any component of the wellhead assembly 129 can be discrete or combined with one or more other components of the wellhead assembly 129. Also, one or more components of the wellhead assembly 129 can have different configurations.

Figure 3:
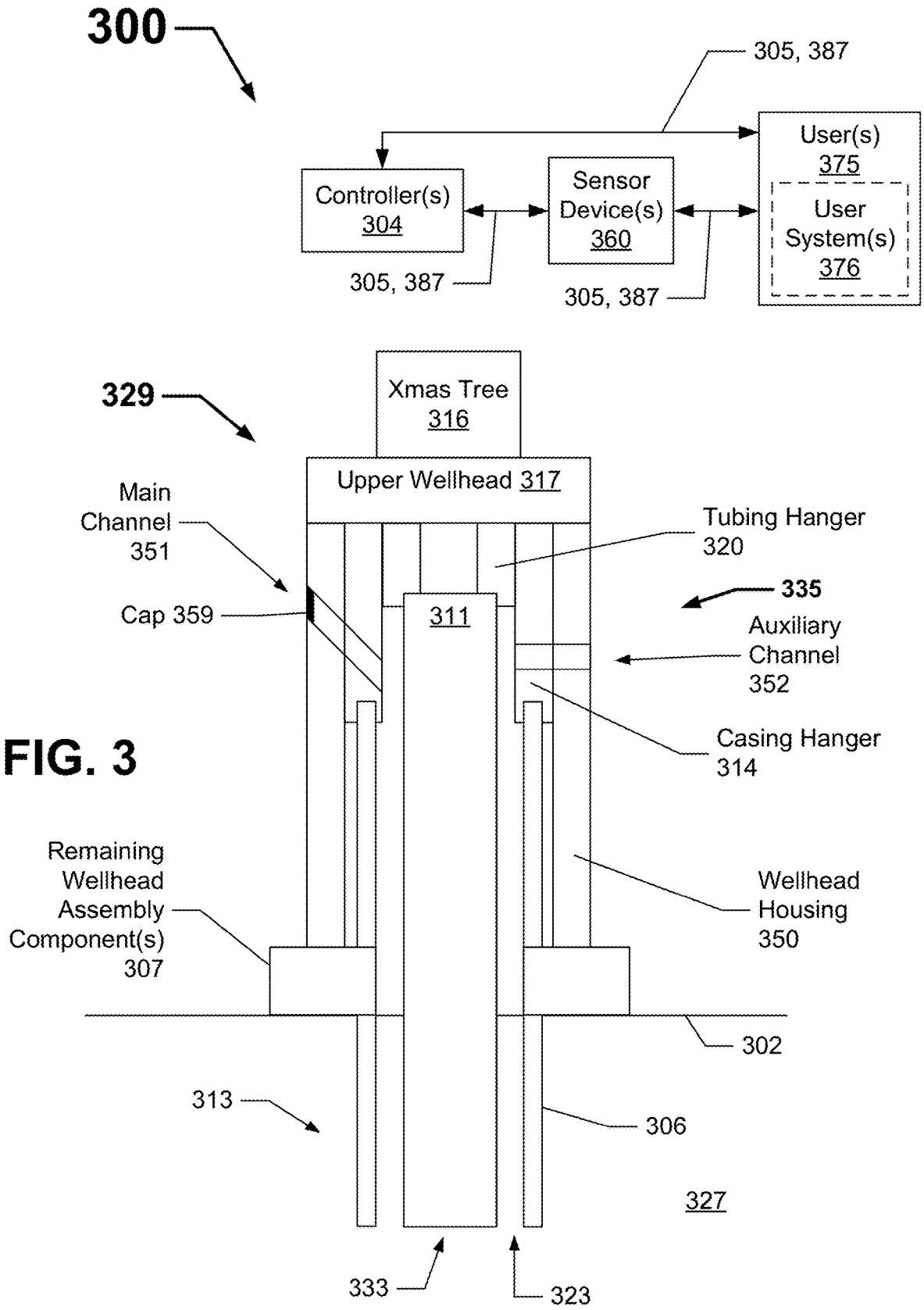
FIG. 3 shows a system that includes another wellhead assembly according to certain example embodiments.
Figure 4A:
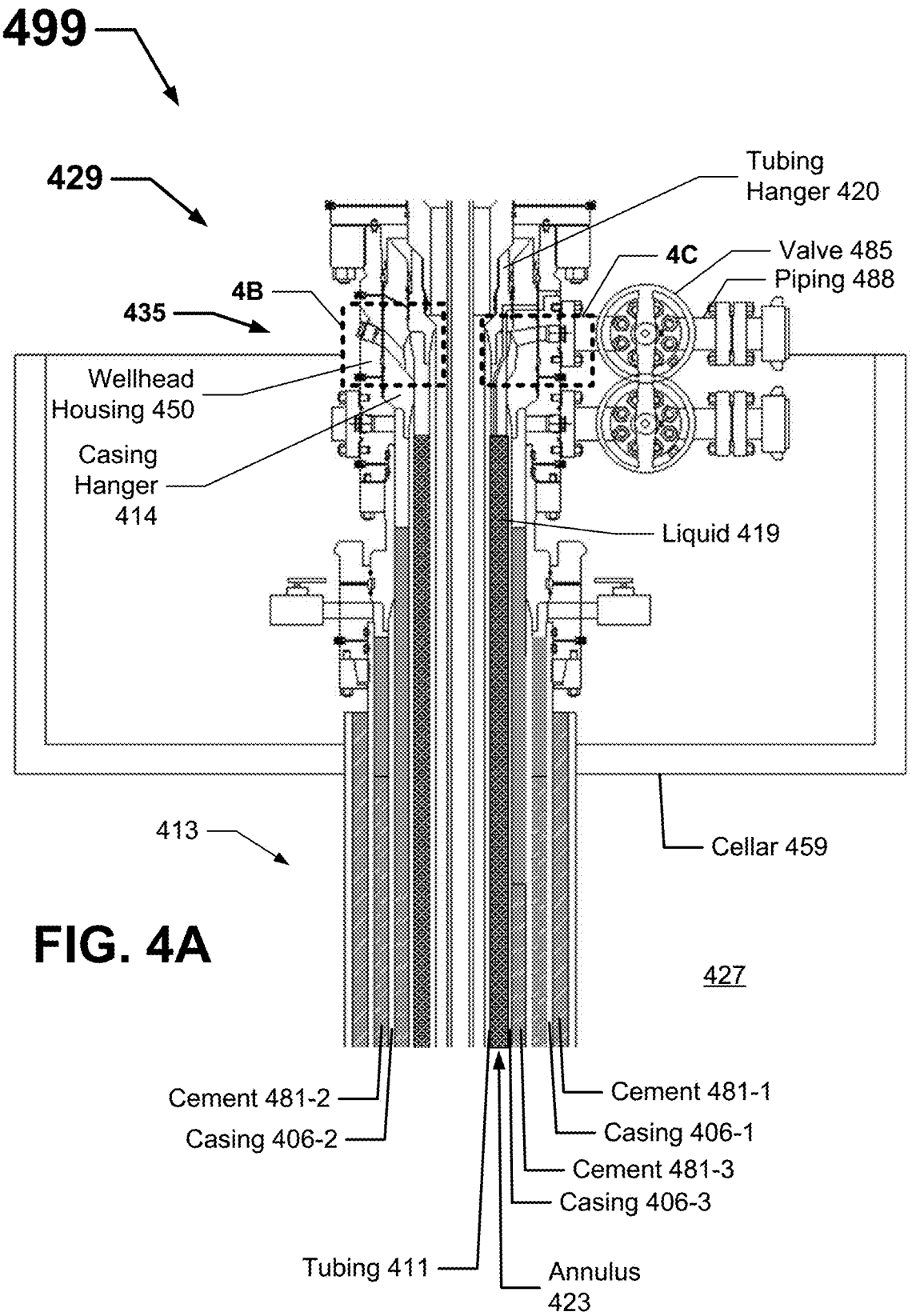
FIGS. 4A through 4C show various views of a portion of a system that includes yet another wellhead assembly according to certain example embodiments.

If the wellbore 113 is more developed, as shown in FIGS. 3A and 4A below, there can be multiple runs of production casing 106 that are concentric with each other, where the oldest run of production casing 106 has a larger diameter and a shorter length relative to the adjacent next oldest run of production casing 106 located further inside the oldest run of production casing 106. In such cases, there is cement in solid form between the adjacent runs of production casing 106. For the oldest run of production casing 106, there is cement in solid form between the run of production casing 106 and the wall in the subterranean formation 127 that forms the wellbore 113.

During drilling and completions operations of the wellbore 113, a run of the production casing 106 is typically inserted to a desired depth after drilling the wellbore 113, and then cement is generally used to solidify the run of production casing 106 within the drilled wellbore 113. During the cementing operation, a cement slurry is pumped downhole to end up between the run of production casing 106 and the wall of the wellbore 113 or the previous run of production casing 106, as appropriate. Sometimes the cement slurry is pumped through the length of the inner bore of the run of production casing 106, out the end, and up through the annulus (the space between the inner run of production casing 106 and the previous run of production casing 106 and/or the wall in the subterranean formation 127 that forms the wellbore 113.

Other times, in what is called reverse circulation, the cement slurry is pumped down the annulus between adjacent runs of production casing 106 until the cement slurry accumulates at the bottom of the current run of production casing 106 and begins to fill the cavity of the current run of production casing 106. In either case, once the cement slurry hardens, the resulting hardened cement bonds the current run of casing 106 to the surrounding rock formation to provide support and strength to the production casing 106. In addition, the hardened cement forms a seal between the production casing 106 and the wellbore 113 to protect oil-producing zones and non-oil-producing zones from contamination.

A user 175 of the system 100 can be any person that interacts, directly or indirectly, with a controller 104, a sensor device 160, the wellbore annulus pressure management system 135 (or component thereof, such as the liquid collection system 145, the fluid injection system 155, and/or the tubing 140), and/or any other component of the system 100. Examples of a user 175 may include, but are not limited to, a company representative, an engineer, a geologist, a consultant, a contractor, and a manufacturer's representative. A user 175 can use one or more user systems 176, which may include a display (e.g., a GUI). A user system 176 of a user 175 can interact with (e.g., send data to, obtain data from) a controller 104, a sensor device 160, the liquid collection system 145, and/or the fluid injection system 155 via an application interface and using the communication links 105.

A user 175 can also interact directly with a controller 104, a sensor device 160, the wellbore annulus pressure management system 135 (or component thereof) through a user interface (e.g., keyboard, mouse, touchscreen). A user system 176 of a user 175 can interact with (e.g., sends data to, receives data from) a controller 104, a sensor device 160, the wellbore annulus pressure management system 135 (or component thereof), and/or another component of the system 100 via an application interface. Examples of a user system 176 can include, but are not limited to, a cell phone with an app, a laptop computer, a handheld device, a smart watch, a desktop computer, and an electronic tablet.

The system 100 can include one or more controllers 104. A controller 104 of the system 100 communicates with and in some cases controls one or more of the other components (e.g., a sensor device 160, the liquid collection system 145, the fluid injection system 155) of the system 100. A controller 104 performs a number of functions that include obtaining and sending data, evaluating data, following protocols, running algorithms, and sending commands. A controller 104 can include one or more of a number of components. Such components of a controller 104 can include, but are not limited to, a control engine, a communication module, a timer, a counter, a power module, a storage repository, a hardware processor, memory, a transceiver, an application interface, and a security module. When there are multiple controllers 104 in the system 100, each controller 104 can operate independently of each other. Alternatively, one or more of the controllers 104 can work cooperatively with each other. As yet another alternative, one of the controllers 104 can control some or all of one or more other controllers 104 in the system 100. In some cases, a controller 104 is an optional component of the system 100.

Each sensor device 160 includes one or more sensors that measure one or more parameters (e.g., pressure, distance, flow rate, temperature, torque, humidity, voltage, current). Examples of a sensor of a sensor device 160 can include, but are not limited to, a temperature sensor, torque sensor, a flow sensor, a pressure sensor, a gas spectrometer, a voltmeter, an ammeter, a permeability meter, a porosimeter, and a camera. A sensor device 160 can be integrated with and/or measure a parameter associated with one or more components (e.g., the tubing 140, the liquid collection system 145, the fluid injection system 155, the wellhead housing 150) of the system 100. For example, a sensor device 160 can be configured to measure a parameter (e.g., a pressure within the annulus 123) associated with using the wellbore annulus pressure management system 135 to remove at least some of the liquid 119 in the annulus 123. In some cases, the measurements made by one or more sensor devices 160, each measuring a different parameter, can be used to determine and confirm whether a controller 104 should take a particular action (e.g., operate a valve, operate or adjust the liquid collection system 145, operate or adjust the fluid injection system 155). In some cases, a sensor device 160 can include its own controller (e.g., controller 104), or portions thereof. In some cases, a sensor device 160 is an optional component of the system 100.

Each communication link 105 can include wired (e.g., Class 1 electrical cables, electrical connectors, Power Line Carrier, RS485) and/or wireless (e.g., sound or pressure waves in water, Wi-Fi, Zigbee, visible light communication, cellular networking, Bluetooth, Bluetooth Low Energy (BLE), ultrawide band (UWB), WirelessHART, ISA100) technology. A communication link 105 can transmit signals (e.g., communication signals, control signals, data) from one component (e.g., a controller 104) of the system 100 to another (e.g., a valve on the Xmas tree 116, the liquid collection system 145, the fluid injection system 155).

Each power transfer link 187 can include one or more electrical conductors, which can be individual or part of one or more electrical cables. In some cases, as with inductive power, power can be transferred wirelessly using power transfer links 187. A power transfer link 187 can transmit power from one component (e.g., a battery, a generator) of the system 100 to another (e.g., a motor of the fluid injection system 155). Each power transfer link 187 can be sized (e.g., 12 gauge, 18 gauge, 4 gauge) in a manner suitable for the amount (e.g., 480V, 24V, 120V) and type (e.g., alternating current, direct current) of power transferred therethrough.

The tubing hanger 120 (also called by other names, including but not limited to the tubing mandrel and the tubing head) of the wellhead assembly 129 is configured to support the tubing string 111. Generally, the tubing hanger 120 is positioned toward the top of the wellhead assembly 129. The tubing hanger 120 can have any of a number of configurations (e.g., mating threads, recesses) and/or components (e.g., pins) to support the tubing string 111 while also incorporating a sealing system to ensure that the cavity 133 within the tubing string 111 and the annulus 123 between the tubing string 111 and the production casing 106 are hydraulically isolated from each other. Once the wellbore 113 is drilled, the production casing 106 is inserted into the wellbore 113 to stabilize the wellbore 113 and allow for the extraction of subterranean resources (e.g., natural gas, oil) from the subterranean formation 127. The production casing 106 is often secured to the subterranean formation 127 using cement injected in an intermediate field operation.

The wellhead housing 150 of the wellhead assembly 129 is a high-pressure housing that supports the one or more production casings 106 and the tubing string 111. Specifically, in this example, the tubing hanger 120, the additional wellhead component 136, and the casing hanger 114 are located within the wellhead housing 150. Further, the top end of the production casing 106 and the top end of the tubing string 111 is also located within the wellhead housing 150. The wellhead housing 150 in this case is located above the surface 102. The wellhead housing 150 and the casing hanger 114 can abut against and form a seal between each other. Similarly, the wellhead housing 150 and the additional wellhead component 136 can abut against and form a seal between each other.

The additional wellhead component 136 can be any component that is positioned within the wellhead housing 150. In some cases, the additional wellhead component 136 is an optional component of the wellhead assembly 129. The additional wellhead component 136 can be one of the remaining wellhead assembly components 107. The upper wellhead 117 is coupled to and is positioned above the wellhead housing 150. The tubing hanger 120 can be positioned inside of the upper wellhead 117, as well as the wellhead housing 150. The Xmas tree 116 is positioned atop the upper wellhead 117. The Xmas tree 116 is an assembly of valves and gauges that controls the flow of fluids into and out of the wellbore 113.

The wellhead housing 150 can be coupled, directly or indirectly, to one or more remaining wellhead assembly components 107. At least one component (e.g., a remaining wellhead assembly component 107) of the wellhead assembly 129 can be positioned at the surface 102. Below the surface 102 is the subterranean formation 127. Within the subterranean formation 127 is one or more (in this case, one) wellbores 113. In some cases, the surface 102 is under water (e.g., a seabed). In such cases, the wellhead assembly 129 can be located in the water.

The wellbore annulus pressure management system 135 of the system 100 of FIGS. 1A through 1C can include one or more of a number of components. In this example, as discussed above, the wellbore annulus pressure management system 135 includes the fluid injection system 155, piping 188, one or more valves 185, the main channel 151, the auxiliary channel 152, tubing 140, and the liquid collection system 145. The fluid injection system 155 of the wellbore annulus pressure management system 135 is located away from the wellhead assembly 129. For example, the fluid injection system 155 can be located on the topsides of a production platform.

The fluid injection system 155 is an optional component of the wellbore annulus pressure management system 135 and can be configured to inject one or more fluids (e.g., a gas) into the annulus 123 under pressure. When this occurs, the pressurized fluid introduced into the annulus 123 by the fluid injection system 155 can displace the liquid 119 within the annulus 123. For example, the pressurized fluid introduced into the annulus 123 by the fluid injection system 155 can force the liquid 119 within the annulus 123 toward the top of the annulus 123. To pressurize the fluids, the fluid injection system 155 can include a compressor, a pump, a motor, and/or any other suitable equipment. The fluid injection system 155 can also include one or more other components used to obtain, process, and deliver the one or more fluids to the annulus 123. Examples of such components can include, but are not limited to, one or more fluid sources, a controller 104, one or more sensor devices 160, piping (e.g., piping 188), one or more valves (e.g., valves 185), a heater, a heat exchanger, a cooler, and a filter.

The fluid provided to the annulus 123 by the fluid injection system 155 travels through piping 188. The piping 188 can include multiple pipes, ducts, elbows, joints, sleeves, collars, and similar components that are coupled to each other (e.g., using coupling features such as mating threads) to establish a network for transporting the fluid at different times. Each component of the piping 188 can have an appropriate size (e.g., inner diameter, outer diameter) and be made of an appropriate material (e.g., steel, PVC) to safely and efficiently handle the pressure, temperature, flow rate, acidity, and other characteristics of the fluid that can flow therethrough from the fluid injection system 155.

The flow rate of the fluid from the fluid injection system 155 to the annulus 123 through the piping 188 can be controlled by one or more of the valves 185. Each of the valves 185 (also sometimes referred to as flow control valves 185) can be placed in-line with the piping 188 to control the flow of one or more fluids from the fluid injection system 155 to the annulus 123 at a given point in time. A valve 185 can be any type of valve, including but not limited to a guillotine valve, a ball valve, a gate valve, a butterfly valve, a pinch valve, a needle valve, a plug valve, a diaphragm valve, and a globe valve. If there are multiple valves 185, then one valve 185 can be configured the same as or differently compared to another valve 185. Each valve 185 can be controlled manually by a user 175 and/or automatically by a controller 104.

The auxiliary channel 152 is also an optional feature of the wellbore annulus pressure management system 135. Specifically, the auxiliary channel 152 is used when the fluid injection system 155 is part of the wellbore annulus pressure management system 135. In such a case, the fluid provided by the fluid injection system 155 through the piping 188 flows through the auxiliary channel 152 to reach the annulus 123. At least part of the auxiliary channel 152 is disposed in and traverses a wall of the wellhead housing 150. For example, as shown in FIG. 1C, channel segment 152-1 of the auxiliary channel 152 runs through a wall of the wellhead housing 150.

If there are no other components of the wellhead assembly 129 disposed between the wellhead housing 150 and the annulus 123, then all of the auxiliary channel 152 runs through the wellhead housing 150, and there is only channel segment 152-1 of the auxiliary channel 152. On the other hand, if there is at least one other component of the wellhead assembly 129 disposed between the wellhead housing 150 and the annulus 123, then a segment of the auxiliary channel 152 runs through each of those other components. For example, in this case, an additional wellhead component 136 is positioned directly between the annulus 123 and the wellhead housing 150. In such a case, channel segment 152-2 of the auxiliary channel 152 runs through a well in the additional wellhead component 136. When the auxiliary channel 152 has multiple segments (channel segment 152-1, channel segment 152-2), all of the segments of the auxiliary channel 152 are positioned relative to each other to form a continuous channel from the piping 188 (outside the wellhead housing 150) to the annulus 123.

The auxiliary channel 152 forms an angle 191 with the outer surface of the wellhead housing 150. In this case, the angle 191 is substantially 90°. In alternative embodiments, the angle 191 formed between the auxiliary channel 152 and the outer surface of the wellhead housing 150 can be obtuse or acute. The auxiliary channel 152 (including any segments) in this example is a continuous cylinder in shape. In alternative embodiments, the auxiliary channel 152 can have a different cross-sectional shape, multiple cross-sectional shapes along its length, one or more bends and/or curves along its length, and/or include other features not shown in FIGS. 1A and 1C.

The main channel 151 of the wellbore annulus pressure management system 135 is used to help remove at least some of the liquid 119 from the annulus 123. The main channel 151 is configured to receive and have disposed therein the tubing 140 so that the distal end of the tubing 140 is positioned within the annulus 123 at a depth that allows for the removal of at least some of the liquid 119 within the annulus 123, and so that the proximal end of the tubing 140 can reach the liquid collection system 145. Typically, the width of the annulus 123 is very small (e.g., an inch, two inches). As a result, in order to allow the tubing 140 to be positioned far enough into the annulus 123, the main channel 151 is set at an obtuse angle 190 with respect to the outer surface of the wellhead housing 150. Put another way, the proximal end of the main channel 151 is located closer to the top end of the wellhead housing 150 compared to the distal end of the main channel 151, and the distal end of the main channel 151 is located closer to the bottom end of the wellhead housing 150 compared to the proximal end of the main channel 151.

With the obtuse angle 190, when the distal end of the tubing 140 is inserted into and exits the main channel 151 (e.g., by a user 175) the distal end of the tubing 140 can easily continue to be pushed downward into the annulus 123. In addition, at a subsequent point in time when the tubing 140, already positioned in the annulus 123, needs to be removed or when the distal end of the tubing 140 needs to be repositioned further up the annulus 123, the obtuse angle 190 facilitates this movement of the tubing 140. By contrast, if the angle 190 is perpendicular (as is the case with the auxiliary channel 152 in this example) or acute, inserting the tubing 140 into the annulus 123 and, if successful, subsequently removing the tubing 140 from the annulus 123 would be difficult and/or cause damage to the tubing 140. The main channel 151 (including any segments) in this example is a continuous cylinder in shape. In alternative embodiments, the main channel 151 can have a different cross-sectional shape, multiple cross-sectional shapes along its length, one or more bends and/or curves along its length, and/or include other features not shown in FIGS. 1A and 1B.

At least part of the main channel 151 is disposed in and traverses a wall of the wellhead housing 150. For example, as shown in FIG. 1B, channel segment 151-1 of the main channel 151 runs through a wall of the wellhead housing 150. If there are no other components of the wellhead assembly 129 disposed between the wellhead housing 150 and the annulus 123, then all of the main channel 151 runs through the wellhead housing 150, and there is only channel segment 151-1 of the main channel 151. On the other hand, if there is at least one other component of the wellhead assembly 129 disposed between the wellhead housing 150 and the annulus 123, then a segment of the main channel 151 runs through each of those other components. For example, in this case, an additional wellhead component 136 is positioned directly between the annulus 123 and the wellhead housing 150. In such a case, channel segment 151-2 of the main channel 151 runs through a well in the additional wellhead component 136. When the main channel 151 has multiple segments (channel segment 151-1, channel segment 151-2), all of the segments of the main channel 151 are positioned relative to each other to form a continuous channel.

The tubing 140 of the wellbore annulus pressure management system 135 is configured to facilitate flow of the liquid 119 from the annulus 123, through the main channel 151, and to the liquid collection system 145. The tubing 140 can be made of a flexible material so that insertion of the tubing 140 through the main channel 151 into the annulus 123, any adjustments to the position of the distal end of the tubing 140 in the annulus 123, and eventual removal of the tubing 140 from the annulus 123 and the main channel 151 can be easily facilitated. In addition, the tubing 140 can be configured to endure long periods of time in the environment (e.g., temperatures, pressures, flow rates, materials within the liquid 119, composition of the liquid 119) in which the tubing 140 is exposed during one or more field operations without deterioration. The tubing 140 can also be of any length (e.g., 10 feet, 50 feet, 100 feet, 500 feet) suitable to be positioned within the annulus 123 to remove at least some of the liquid 119 and to simultaneously reach the liquid collection system 145.

The liquid collection system 145 of the wellbore annulus pressure management system 135 can be configured to receive the liquid 119 that is removed from the annulus 123 through the tubing 140. In some cases, the liquid collection system 145 can include suitable equipment (e.g., a pump, a motor, a suction component) that actively draws the liquid 119 out of the annulus 123 through the tubing 140 and collects the liquid 119. In alternative embodiments, the liquid collection system 145 includes any suitable equipment (e.g., one or more storage tanks) that merely collects the liquid 119 flowing through the tubing 140 without having to draw the liquid 119 out of the annulus 123. The liquid collection system 145 can also include one or more other components used to obtain, process, and deliver the one or more liquids 119 received from the annulus 123. Examples of such components can include, but are not limited to, one or more liquid consumption resources, a controller 104, one or more sensor devices 160, piping (e.g., piping 188), one or more valves (e.g., valves 185), a heater, a heat exchanger, a cooler, a separator, and a filter.

Figure 2A:
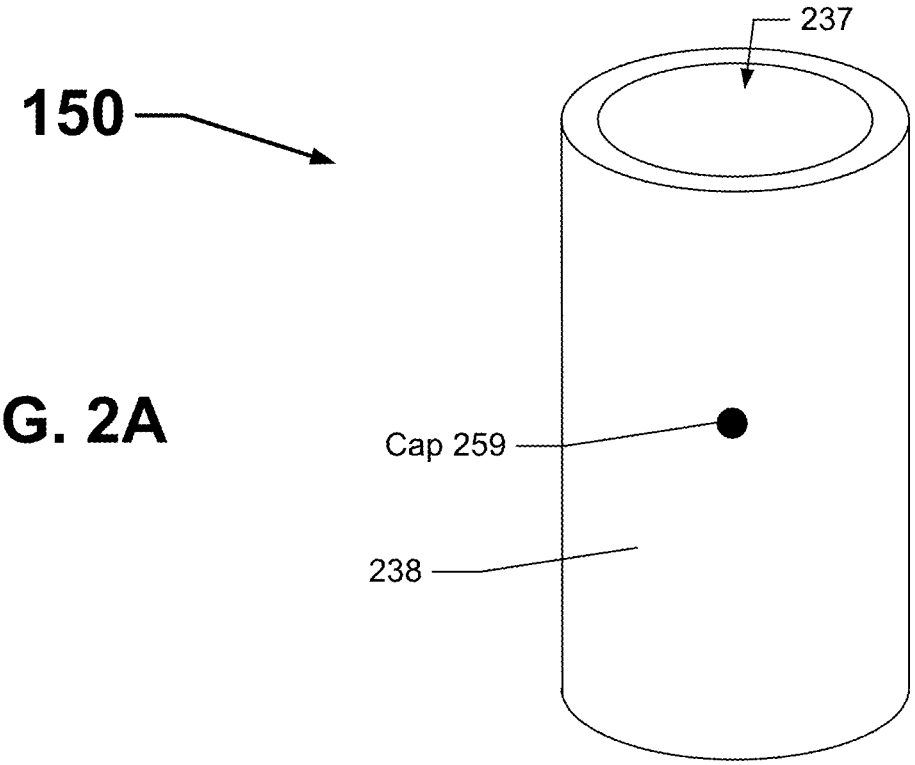
FIGS. 2A through 2C show the wellhead housing of the wellbore annulus pressure management system of FIGS. 1A through 1C according to certain example embodiments.
Figure 2B:
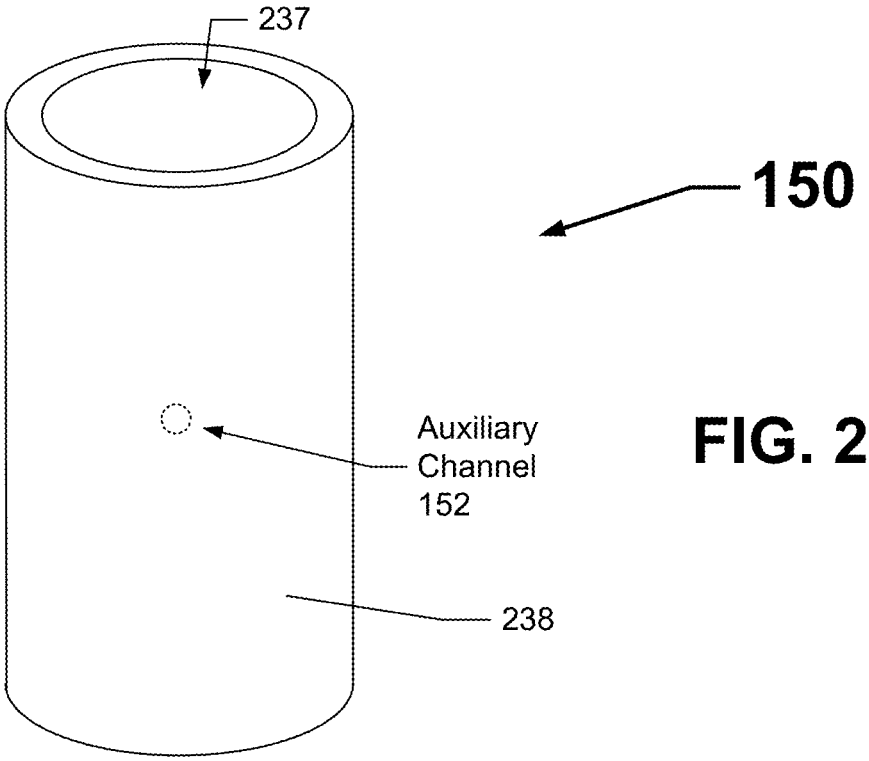
Figure 2C:
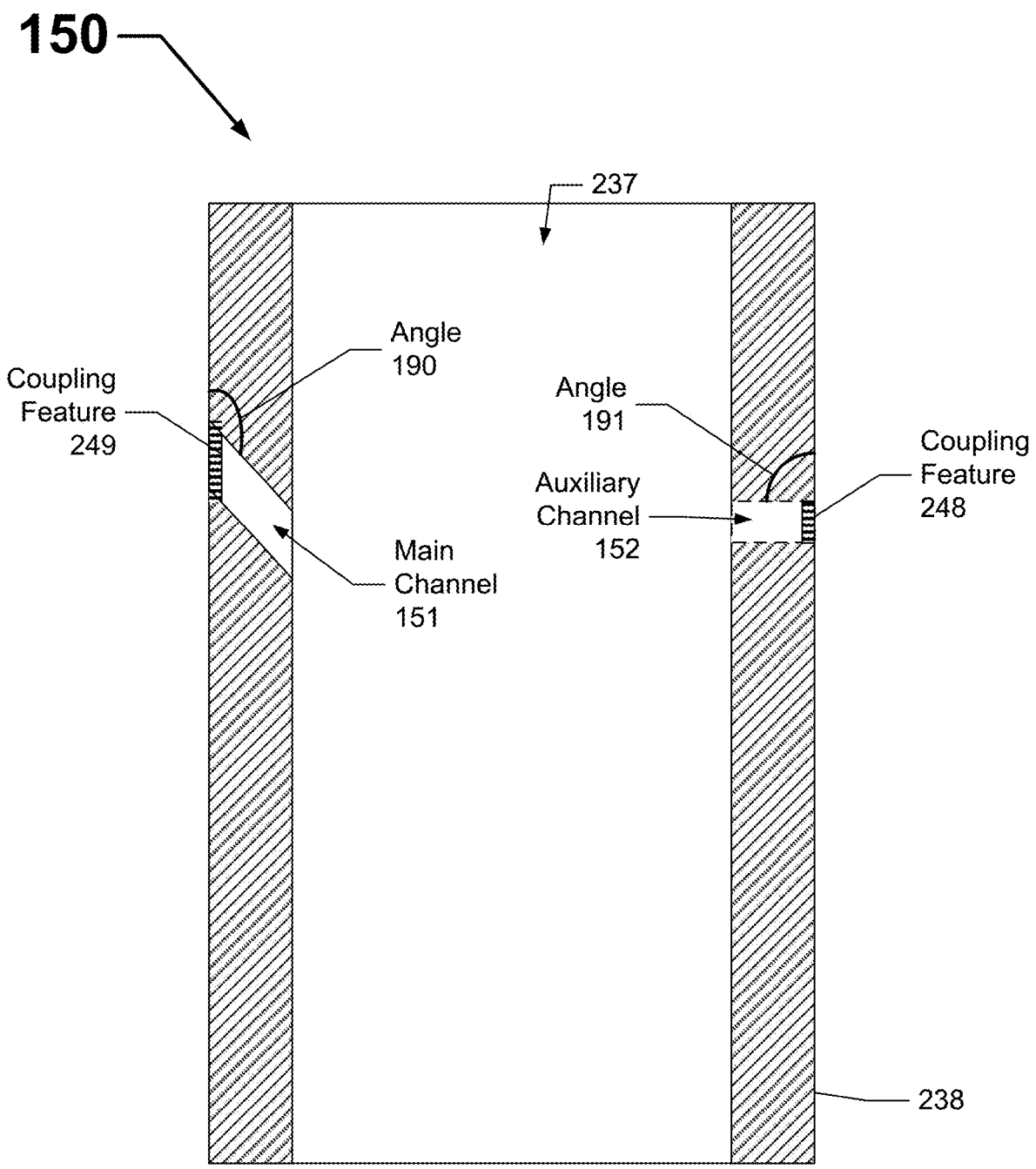

FIGS. 2A through 2C show the wellhead housing 150 of the wellbore annulus pressure management system 135 of FIGS. 1A through 1C according to certain example embodiments. Specifically, FIG. 2A shows a left side top perspective view of the wellhead housing 150. FIG. 2B shows a right side top perspective view of the wellhead housing 150. FIG. 2C shows a front sectional view of the wellhead housing. Referring to FIGS. 1A through 2C, the wellhead housing 150 includes a body 238 having a top end (shown adjacent to the upper wellhead 117 in FIG. 1A), a bottom end (shown adjacent to the other wellhead assembly components 107 in FIG. 1A), and a cavity 237 that traverses its length between the top end and the bottom end.

The wellhead housing 150 of FIGS. 2A through 2C also includes the main channel 151, where a proximal end of the main channel 151 is located closer to the top end of the body 238 compared to a distal end of the main channel 151, and where the distal end of the main channel 151 is located closer to the bottom end of the body 238 compared to the proximal end of the main channel 151. In other words, the angle 190 formed between the main channel 151 and the outer perimeter of the body 238 is obtuse. The proximal end of the main channel 151 has a coupling feature 249 (e.g., mating threads disposed on the surface of the main channel 151 at the proximal end, threaded apertures adjacent to the proximal end of the main channel 151) that are used to couple to the cap 259. The cap 259 can be removable by a user 175. When applied, the cap 259 closes off the main channel 151. When removed, the cap 259 allows the main channel 151 to be open, allowing the tubing (e.g., tubing 140) of be inserted therein and/or allowing the liquid (e.g., liquid 119) to flow therethrough from the annulus (e.g., annulus 123).

The wellhead housing 150 of FIGS. 2A through 2C also includes the optional auxiliary channel 152. The angle 191 formed between the auxiliary channel 152 and the outer perimeter of the body 238 is substantially 90°. The proximal end of the auxiliary channel 152 has a coupling feature 248 (e.g., mating threads disposed on the surface of the auxiliary channel 152 at the proximal end, threaded apertures adjacent to the proximal end of the auxiliary channel 152) that are used to couple to piping (e.g., piping 188). The main channel 151 and the auxiliary channel 152 in this case are substantially cylindrical. This configuration allows the main channel 151 to receive tubing (e.g., tubing 140), which can be inserted through the main channel 151, can remain stationary within the main channel 151, and removed from the main channel 151 at different points in time.

FIG. 3 shows a system 300 that includes another wellhead assembly 329 according to certain example embodiments. Referring to FIGS. 1A through 3, the system 300 of FIG. 3 is substantially the same as the system 100 of FIGS. 1A through 2C, except as discussed below. For example, the system 300 of FIG. 3 includes a wellhead assembly 329, a Xmas tree 316 mounted atop the wellhead assembly 329, a wellbore 313 in a subterranean formation 327, one or more controllers 304, one or more sensor devices 360, and one or more users 375, which can each include one or more user systems 376. The wellhead assembly 329 of the system 300 can include an upper wellhead 317, a tubing hanger 320, a casing hanger 314, a wellhead housing 350, the example wellbore annulus pressure management system 335, and one or more of a number of remaining wellhead assembly components 307.

The wellbore annulus pressure management system 335 includes a fluid injection system (not shown), piping (not shown), one or more valves (not shown), a main channel 351, an auxiliary channel 352, tubing (not shown), and a liquid collection system (not shown). The main channel 351 of the wellbore annulus pressure management system 335 can have a removable cap 359. The wellbore 313 has a production casing 306, inside of which is positioned a tubing string 311. The tubing string 311 has a cavity 333 that extends continuously along its length, and there is an annulus 323 between the tubing string 311 and the production casing 306 that extends continuously along its length. One or more liquids 319 fill some amount of the annulus 323, and at least some of the liquid 319 can be removed by the wellbore annulus pressure management system 335 to avoid adverse effects that can result from excess pressure in the annulus 323. All of these components of the system 300 are substantially the same as the corresponding components of the system 100.

In this case, the system 300 does not include an additional wellhead component, such as the additional wellhead component 136 of the system 100 discussed above. Since the system 300 does not include an additional wellhead component, a segment of the main channel 351 and a segment of the auxiliary channel 352 are disposed in the casing hanger 314. In alternative embodiments, the main channel 351 and/or the auxiliary channel 352 have only one segment, which is disposed in the wall of the wellhead housing 350.

Figure 4B:
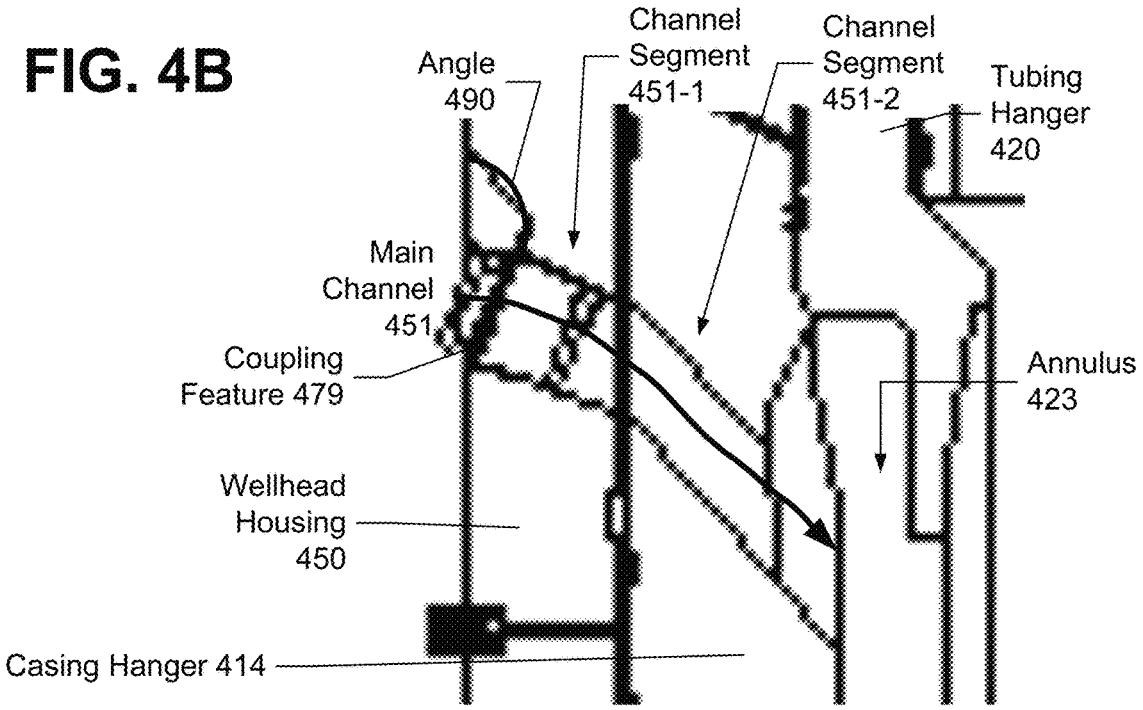
Figure 4C:
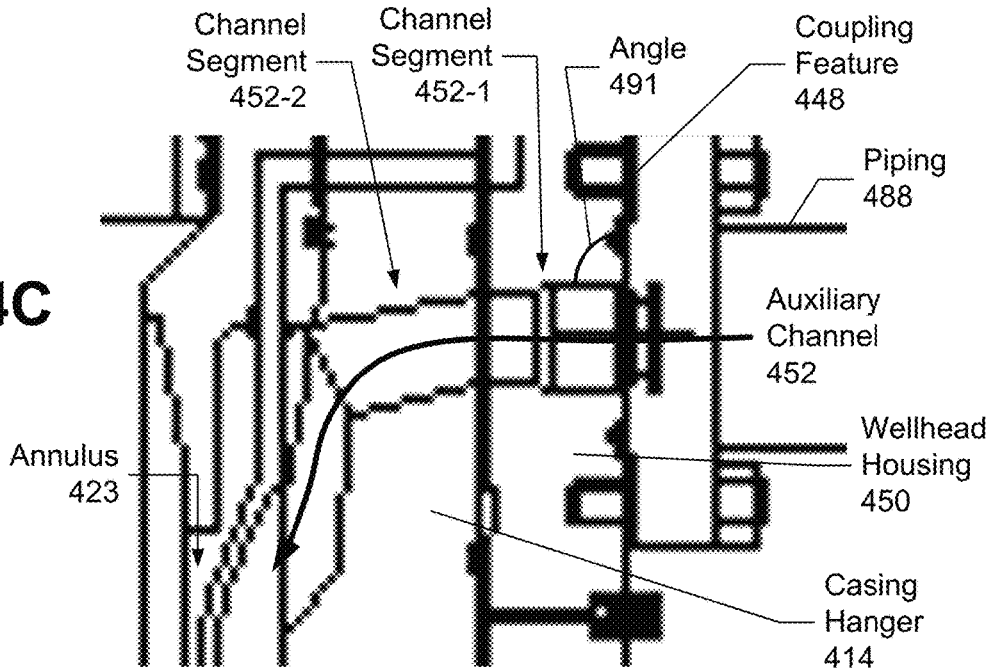

FIGS. 4A through 4C show various views of a portion 499 of a system that includes yet another wellhead assembly 429 according to certain example embodiments. Specifically, FIG. 4A shows a semi-sectional view of the portion 499 of the system. FIG. 4B shows a detailed view of the main channel 451 of the wellbore annulus pressure management system 435 of the portion of the system of FIG. 4A. FIG. 4C shows a detailed view of the auxiliary channel 452 of the wellbore annulus pressure management system 435 of the portion 499 of the system of FIG. 4A.

Referring to FIGS. 1A through 4C, the portion 499 of the system of FIGS. 4A through 4C includes wellhead assembly 429 and a wellbore 413 in a subterranean formation 427. The wellhead assembly 429 of FIGS. 4A through 4C includes a tubing hanger 420, a casing hanger 414, a wellhead housing 450, and the example wellbore annulus pressure management system 435. In this case, the wellhead assembly 429 is positioned within a cellar 459. The wellbore annulus pressure management system 435 includes piping 488, a valve 485, the main channel 451, and the auxiliary channel 452. The main channel 451 of the wellbore annulus pressure management system 335 can have a coupling feature 479 for coupling to a removable cap (e.g., removable cap 359).

The wellbore 413 in this case has three concentric production casings 406, inside of which is positioned a tubing string 411. Specifically, production casing 406-1 is the outer-most of the production casings 406, and cement 481-1 in a solid state is set between production casing 406-1 and the subterranean formation 427. Production casing 406-2 is inside of production casing 406-1, and cement 481-2 in a solid state is set between production casing 406-1 and production casing 406-2. Production casing 406-3 is inside of production casing 406-2, and cement 481-3 in a solid state is set between production casing 406-3 and production casing 406-2. The tubing string 411 has a cavity 433 that extends continuously along its length, and there is an annulus 423 between the tubing string 411 and the production casing 406-3 that extends continuously along its length. The liquid 419 in this case fills most of the annulus 423, which can lead to adverse effects that can result from excess pressure in the annulus 423.

All of these components of the portion 499 of the system are substantially the same as the corresponding components of the systems discussed above. Further, the system of which the portion 499 is a part can include any of a number of other components (e.g., a Xmas tree, one or more controllers, one or more sensor devices, and one or more users, one or more user systems, an upper wellhead, a fluid injection system, a liquid collection system, a removable cap, one or more of a number of remaining wellhead assembly components, tubing) discussed above with respect to the other systems.

The auxiliary channel 452 of the wellbore annulus pressure management system 435 has two segments. Specifically, as shown in FIG. 4C, the auxiliary channel segment 452-1 of the auxiliary channel 452 is disposed in and traverses the wall of the wellhead housing 450, where the proximal end of the auxiliary channel segment 452-1 coinciding with the outer surface of the wellhead housing 150, and where the distal end of the auxiliary channel segment 452-1 coinciding with the inner surface of the wellhead housing 150. Also, the auxiliary channel segment 452-2 of the auxiliary channel 452 is disposed in and traverses the wall of the casing hanger 414, where the proximal end of the auxiliary channel segment 452-2 coinciding with the outer surface of the casing hanger 414, and where the distal end of the auxiliary channel segment 452-2 coinciding with the inner surface of the casing hanger 414. Auxiliary channel segment 452-1 and channel segment 452-2 of the auxiliary channel 452 are positioned relative to each other to form a continuous channel from the piping 488 (outside the wellhead housing 450) to the annulus 423.

In this case, however, the auxiliary channel 452 is not linear throughout. Specifically, auxiliary channel segment 452-1 is substantially linear and forms an angle 491 with the outer surface of the wellhead housing 450. In this case, the angle 491 is substantially 90°. In other words, the auxiliary channel segment 452-1 is substantially horizontal and is linear with the piping 488. Auxiliary channel segment 452-2, while continuous with the auxiliary channel segment 452-1, is not linearly aligned with the auxiliary channel segment 452-1. In this case, the auxiliary channel segment 452-2 starts with a slight downward turn (has a slight downward slope), and then the amount of downward turn of the auxiliary channel segment 452-2 increases to the point of becoming almost vertical at the distal end of the auxiliary channel segment 452-2, which is where the auxiliary channel 452 joins the annulus 423. In other words, the slope of the auxiliary channel 452 increases toward its distal end relative to its proximal end. The cross-sectional shape of the auxiliary channel 452 (including its segments) in this example is circular or oval along its length.

The proximal end of the auxiliary channel 452, which includes auxiliary channel segment 452-1, includes multiple coupling features 448 (in this case, in the form of threaded apertures located adjacent to the proximal end of the auxiliary channel 452) to allow the piping 488 to indirectly couple to the wellhead housing 450. The positioning of the coupling features 448 allows the piping 488 to be properly aligned with the auxiliary channel segment 452-1, which represents the proximal end of the auxiliary channel 452.

Similarly, the main channel 451 of the wellbore annulus pressure management system 435 has two segments. Specifically, as shown in FIG. 4B, the main channel segment 451-1 of the main channel 451 is disposed in and traverses the wall of the wellhead housing 450, where the proximal end of the main channel segment 451-1 coinciding with the outer surface of the wellhead housing 150, and where the distal end of the main channel segment 451-1 coinciding with the inner surface of the wellhead housing 150. Also, the main channel segment 451-2 of the main channel 451 is disposed in and traverses the wall of the casing hanger 414, where the proximal end of the main channel segment 451-2 coinciding with the outer surface of the casing hanger 414, and where the distal end of the main channel segment 451-2 coinciding with the inner surface of the casing hanger 414. Main channel segment 451-1 and main channel segment 451-2 of the main channel 451 are positioned relative to each other to form a continuous channel therethrough.

In this case, however, the main channel 451 is not linear throughout. Specifically, main channel segment 451-1 is substantially linear and forms an angle 490 with the outer surface of the wellhead housing 450. In this case, the angle 490 is obtuse. In other words, the main channel segment 451-1 has a downward slope and is substantially linear. Main channel segment 451-2, while continuous with the main channel segment 451-1, is not linearly aligned with the main channel segment 451-1. In this case, the main channel segment 451-2 starts with a slight downward turn (has a slightly further downward slope relative to the main channel segment 451-1), and then remains substantially linear to the distal end of the main channel segment 451-2, which is where the main channel 451 joins the annulus 423. In other words, the slope of the main channel 451 increases toward its distal end relative to its proximal end. The cross-sectional shape of the main channel 451 (including its segments) in this example is substantially circular along its length.

The proximal end of the main channel 451, which includes main channel segment 451-1, includes a coupling feature 479 (in this case, in the form of mating threads disposed along the outer surface of the main channel 451 at its proximal end) to allow a cap (e.g., cap 359) to directly couple to the wellhead housing 450 at the proximal end of the main channel 451. The positioning of the coupling feature 479 allows the cap to seal the main channel 451.

Figure 5:
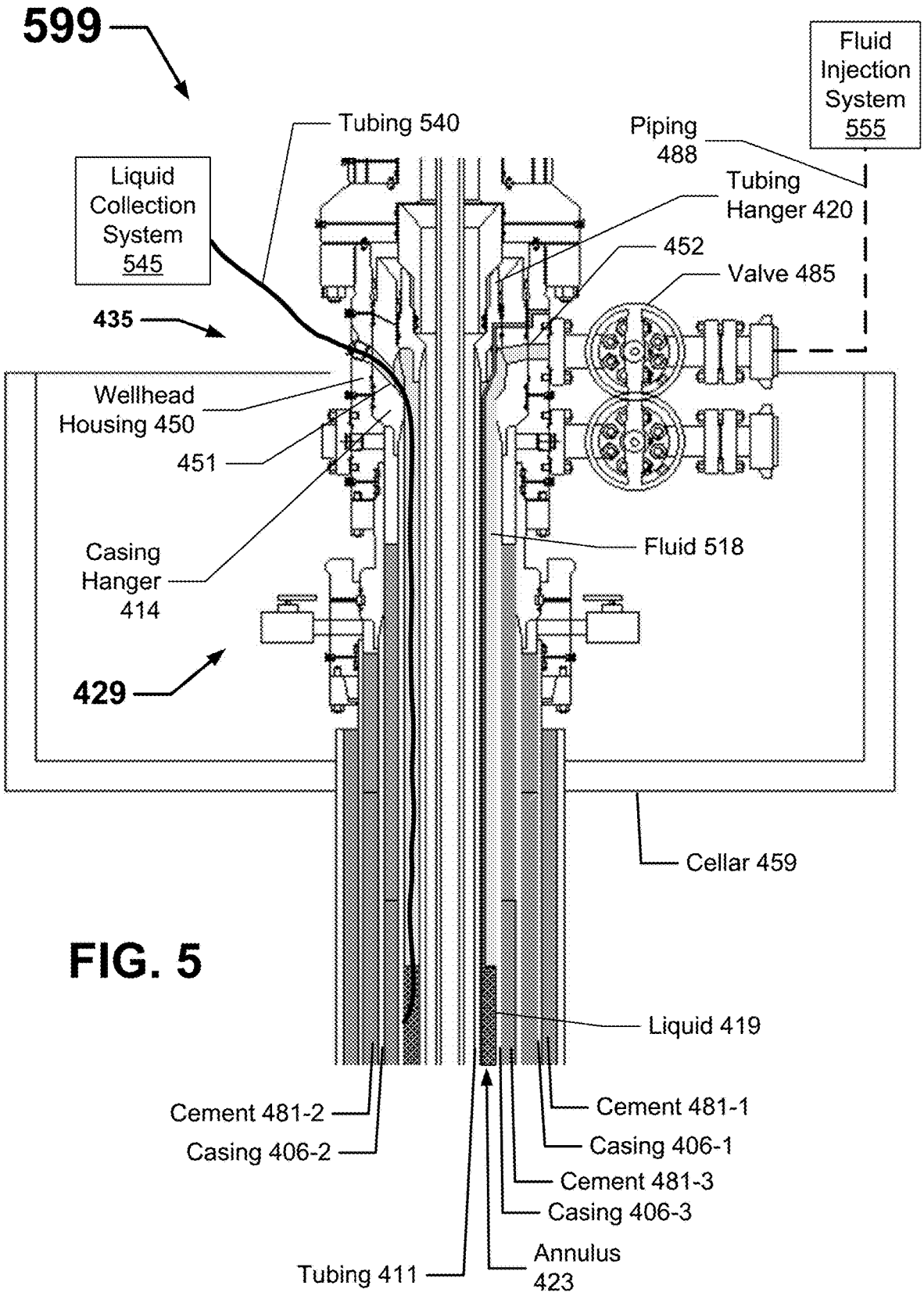
FIG. 5 shows a portion of the system of FIGS. 4A through 4C during a different phase of a field operation according to certain example embodiments.

FIG. 5 shows a portion 599 of the system of FIGS. 4A through 4C during a different phase of a field operation according to certain example embodiments. Referring to FIGS. 1A through 5, the portion 599 of the system shown in FIG. 5 has the same components shown in FIG. 4A. For example, the portion 599 of the system of FIG. 5 includes the tubing hanger 420, the casing hanger 414, the wellhead housing 450, and the example wellbore annulus pressure management system 435. The wellhead assembly 429 is still positioned within the cellar 459. The wellbore annulus pressure management system 435 includes the piping 488, the valve 485, the main channel 451, and the auxiliary channel 452.

The wellbore 413 has the three concentric production casings 406, inside of which is positioned the tubing string 411. Specifically, production casing 406-1 is the outer-most of the production casings 406, and cement 481-1 in a solid state is set between production casing 406-1 and the subterranean formation 427. Production casing 406-2 is inside of production casing 406-1, and cement 481-2 in a solid state is set between production casing 406-1 and production casing 406-2. Production casing 406-3 is inside of production casing 406-2, and cement 481-3 in a solid state is set between production casing 406-3 and production casing 406-2. The tubing string 411 has the cavity 433 that extends continuously along its length, and the annulus 423, disposed between the tubing string 411 and the production casing 406-3, extends continuously along its length. The liquid 419 is in the annulus 423, although at the point in time captured in FIG. 5, the level of the liquid 419 in the annulus 423 is below the bottom of the cellar 459.

Additional components not shown in FIGS. 4A through 4C are included in FIG. 5. For example, the portion 599 of the system of FIG. 5 also includes tubing 540, a liquid collection system 545, a fluid injection system 555, and fluid 518, all part of the example annulus pressure management system 435. All of these components of the portion 599 of the system of FIG. 5 are substantially the same as the corresponding components of the systems discussed above. Further, the system of which the portion 599 is a part can include any of a number of other components (e.g., a Xmas tree, one or more controllers, one or more sensor devices, and one or more users, one or more user systems, an upper wellhead, a removable cap, one or more of a number of remaining wellhead assembly components) discussed above with respect to the other systems.

The tubing 540 is inserted through the main channel 451 (which in this case includes the main channel segment 451-1 and the main channel segment 451-2) far enough that the distal end of the tubing 540 is submerged in the liquid 419 in the annulus 423. The tubing 540 can be inserted into the main channel segment 451-1 and the main channel segment 451-2 when a pressure within the annulus 423 reaches a threshold value. The proximal end of the tubing 540 is connected to the liquid collection system 545, which collects the liquid 419 removed from the annulus 423 through the tubing 540. In some cases, the liquid collection system 545 draws the liquid 419 out of the annulus 423 through the tubing 540. In certain example embodiments, the proximal end of the tubing 540 is accessible at or above a surface (e.g., surface 302) where field operations are conducted.

The fluid injection system 555 is coupled to the auxiliary channel 452 that traverses the wellhead housing 450. The fluid injection system 555 is used to inject the fluid 518 through the piping 488 and the auxiliary channel 452 into the top end of the annulus 423 to force the liquid 419 out of the annulus 423 through the tubing 540. The valve 485 controls the flow of the fluid 519 into the annulus 423 through the auxiliary channel 452. In certain example embodiments, the fluid 519 is or includes a gas.

Figure 6:
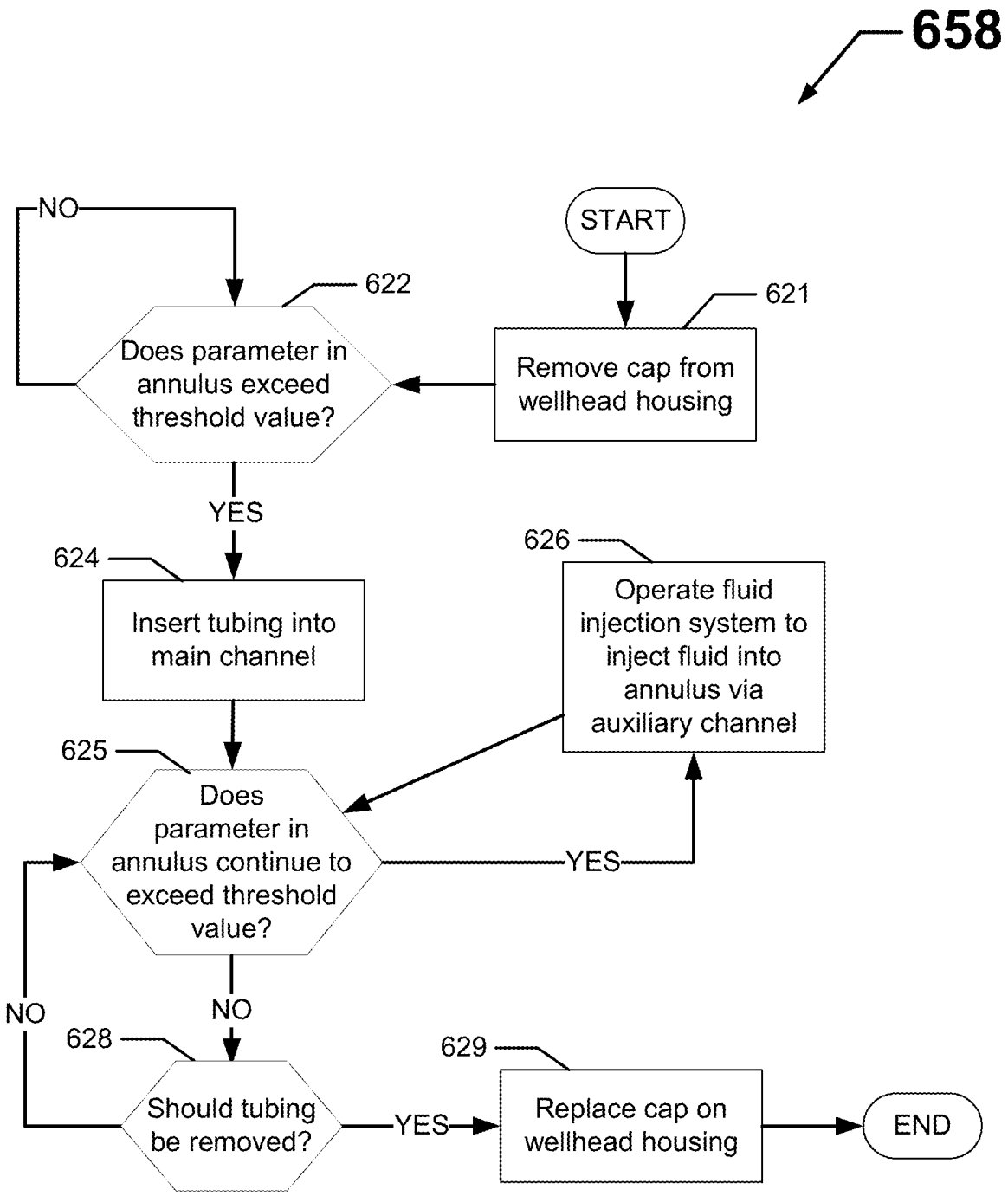
FIG. 6 shows a flowchart of a method for managing wellbore annulus pressure according to certain example embodiments.

FIG. 6 shows a flowchart 658 of a method for managing wellbore annulus pressure according to certain example embodiments. While the various steps in this flowchart 658 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 6 may be included in performing this method shown in the flowchart 658. Accordingly, the specific arrangement of steps should not be construed as limiting the scope. Further, a controller or other type of computing device with a non-transitory computer readable medium can be used to perform one or more of the steps for the method shown in FIG. 6 in certain example embodiments. Any of the functions performed below by a controller can involve the use of one or more protocols, one or more algorithms, measurements from one or more sensor devices, and/or stored data stored in a storage repository. In addition, or in the alternative, any of the functions in the method can be performed by a user.

The method shown in FIG. 6 is merely an example that can be performed by using an example wellbore annulus pressure management system described herein. In other words, systems for managing wellbore annulus pressure can perform other functions using other methods in addition to and/or aside from those shown in FIG. 6. Referring to FIGS. 1A through 6, the method shown in the flowchart 658 of FIG. 6 begins at the START step and proceeds to step 621, where the cap 359 is removed from the wellhead housing 150. The cap 359 can be removed by a user 175, with or without the use of a user system 176. Alternatively, the cap 359 can be removed in an automated way using a controller 104. Removal of the cap 359 can be based on a reading (e.g., a pressure, a volume of the liquid 119, a height of the liquid 119) within the annulus 123 by a sensor device 160 that exceeds a threshold value. Removing the cap 359 exposes the main channel 151, making the main channel 151 accessible.

In step 622, a determination is made as to whether a parameter in the annulus 123 exceeds a threshold value. The parameter can be measured by one or more sensor devices 160. The parameter can be or include a pressure in the annulus 123, a temperature in the annulus 123, a volume of the liquid 119 in the annulus 123, a height or level of the liquid 119 in the annulus 123, and/or any other suitable indication that an overpressure situation in the annulus 123 can result without taking remedial action. The determination can be made by a user 175, with or without an associated user system 176. In addition, or in the alternative, the determination can be made by a controller 104 using one or more protocols, one or more algorithms, and/or stored data (which can include the threshold value). If the parameter in the annulus 123 exceeds the threshold value, then the process proceeds to step 624. If the parameter in the annulus 123 does not exceed the threshold value, then this step 622 can be repeated.

In step 624, the tubing 140 is inserted into the main channel 151. The tubing can be inserted through the main channel 151 in the wellhead housing 150. In some cases, the tubing 140 can be inserted to the extent that the distal end of the tubing 140 can be disposed in the liquid 119 in the annulus 123. In certain example embodiments, the main channel 151 forms an obtuse angle 190 with the outer surface of the wellhead housing 150 to facilitate easier insertion of the tubing 140 into the annulus 123. The tubing 140 can be inserted by a user 175, with or without the use of a user system 176. Alternatively, the tubing 140 can be inserted in an automated way (e.g., using a machine) using a controller 104. In some cases, the proximal end of the tubing 140 is connected to a liquid collection system 145.

In such cases, the liquid collection system 145 can actively (e.g., using suction) or passively collect the liquid 119 that flows out of the annulus 123 through the tubing 140. If the liquid collection system 145 is active, the liquid collection system 145 (or portions thereof) can be operated by a user 175 (including a user system 176) and/or by a controller 104. Operation of the liquid collection system 145 can be based, at least in part, on measurements of one or more parameters (e.g., flow rate, volume, pressure, temperature) made by one or more sensor devices 160.

In step 625, a determination is made as to whether the parameter in the annulus 123 continues to exceed a threshold value. The parameter can be measured by one or more sensor devices 160. The parameter can be or include a pressure in the annulus 123, a temperature in the annulus 123, a volume of the liquid 119 in the annulus 123, a height or level of the liquid 119 in the annulus 123, and/or any other suitable indication that an overpressure situation in the annulus 123 can continue to result without taking further remedial action. The determination can be made by a user 175, with or without an associated user system 176. In addition, or in the alternative, the determination can be made by a controller 104 using one or more protocols, one or more algorithms, and/or stored data (which can include the threshold value). If the parameter in the annulus 123 continues to exceed the threshold value, then the process proceeds to step 626. If the parameter in the annulus 123 does not continue to exceed the threshold value, then the process proceeds to step 628.

In step 626, the fluid injection system 155 is operated to inject fluid 518 into the annulus 123 via the auxiliary channel 152. Specifically, the fluid injection system 155 can be used to inject a fluid 518 (e.g., a gas) through the piping 188, at least one valve 185, and the auxiliary channel 152 into the annulus 123. The fluid 518 can be pressurized using equipment (e.g., a compressor, a pump, a motor) in the fluid injection system 155. In such cases, the fluid 518 can force the liquid 119 in the annulus 123 to rise toward the top of the annulus 123, into the distal end of the tubing 140, and up the tubing 140. The fluid injection system 155 (or portions thereof) can be operated by a user 175 (including a user system 176) and/or by a controller 104. Operation of the fluid injection system 155 can be based, at least in part, on measurements of one or more parameters (e.g., flow rate, volume, pressure, temperature) made by one or more sensor devices 160. If the liquid collection system 145 is an active system, then the liquid collection system 145 can simultaneously be operated in conjunction with the fluid injection system 155. When step 626 is complete, the process can revert to step 625.

In step 628, a determination is made as to whether the tubing 140 should be removed. Specifically, a determination is made as to whether the tubing 140 should be removed from the annulus 123 and the main channel 151. In some cases, the tubing 140 can be removed by a user 175, with or without the use of a user system 176. Alternatively, the tubing 140 can be removed in an automated way (e.g., using a machine) using a controller 104. If the tubing 140 should be removed, then the tubing is actually removed, and the process proceeds to step 629. If the tubing 140 should not be removed, then the process reverts to step 625.

In step 629, the cap 359 is replaced on the wellhead housing 150. The cap 359 can be replaced by a user 175, with or without the use of a user system 176. Alternatively, the cap 359 can be replaced in an automated way (e.g., using a machine) using a controller 104. Replacement of the cap 359 can be based on a reading (e.g., a pressure, a volume of the liquid 119, a height of the liquid 119) within the annulus 123 by a sensor device 160 that falls within a range of acceptable values. Replacing the cap 359 covers the main channel 151, making the main channel 151 inaccessible. When step 629 is complete, the process can proceed to the END step.

In some cases, example embodiments discussed herein are directed to a wellhead housing of a wellhead assembly. In such cases, the wellhead housing may include a main channel that traverses a body, where the main channel has a proximal end that is located closer to a top end of the body compared to a distal end of the main channel, and where the distal end of the main channel is located closer to a bottom end of the body compared to the proximal end of the main channel. In such cases, the main channel may be substantially cylindrical.

In some cases, example embodiments discussed herein are directed to a system for removing liquid from an annulus in a wellbore. In such cases, the system may include a fluid injection system coupled to an auxiliary channel that traverses a wellhead housing, where the fluid injection system is configured to inject a fluid into an annulus to force a liquid out of the annulus through a tubing. In addition, or in the alternative, in some cases, the fluid injection system may include a valve configured to control a flow of the fluid to the annulus. In some cases, the fluid may include a gas.

In some cases, example embodiments discussed herein are directed to a method for removing liquid from an annulus in a wellbore. In such cases, the method may include removing a cap from a wellhead housing to expose a main channel prior to inserting a tubing. In addition, or in the alternative, in such cases, the method may include operating a fluid injection system to inject fluid into the annulus through an auxiliary channel in the wellhead housing, where the fluid is or includes a gas. In addition, or in the alternative, in such cases, the method may include removing the tubing from the main channel after the fluid is removed from the annulus. In addition, or in the alternative, in such cases, the method may include coupling a cap to the wellhead housing to cover the main channel after the tubing is removed.

Example embodiments can be used to provide wellbore annulus pressure management. Example embodiments can be used in land-based or offshore field operations. Example embodiments also provide a number of other benefits. For instance, example embodiments can reduce or prevent unwanted and/or unexpected pressures within the annulus using a main channel that forms an obtuse angle with the wellhead housing to allow for easy insertion and removal of tubing to remove liquids in the annulus. Such other benefits can include, but are not limited to, more efficient use of resources, time savings, cost savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A wellhead housing of a wellhead assembly, the wellhead housing comprising:

a body having a top end, a bottom end, and a cavity that traverses its length between the top end and the bottom end;

a main channel that traverses the body, wherein the main channel has a proximal end that is located closer to the top end of the body compared to a distal end of the main channel, wherein the distal end of the main channel is located closer to the bottom end of the body compared to the proximal end of the main channel, wherein the main channel is configured to have disposed therein tubing, wherein one end of the tubing is configured to terminate in an annulus located within part of the cavity of the body between a tubing string and a casing string, and wherein an opposite end of the tubing is configured to connect to a liquid collection system; and an auxiliary channel that traverses the body, wherein the auxiliary channel is configured to have piping coupled thereto, wherein a distal end of the auxiliary channel is configured to terminate in the annulus, and wherein the piping is further configured to connect to a fluid injection system.

2. The wellhead housing of claim 1, wherein the proximal end of the main channel comprises a coupling feature that is configured to couple to a removable cap.

3. The wellhead housing of claim 1, wherein the body comprises a piping coupling feature along the outer perimeter adjacent to the auxiliary channel.

4. The wellhead housing of claim 1, wherein the main channel has a slope that increases toward its distal end relative to its proximal end.

5. A system for removing liquid from an annulus in a wellbore, the system comprising:

a wellhead housing comprising:

a wellhead housing body having a top end, a bottom end, and a wellhead housing cavity that traverses its length between the top end and the bottom end, wherein the annulus is within the wellhead housing cavity between a tubing string and a casing string;

a first main channel segment of a main channel, wherein the first main channel segment traverses the wellhead housing body, wherein the first main channel segment has a proximal end at an outer perimeter of the wellhead housing body and a distal end at an inner perimeter of the wellhead housing body, wherein the proximal end of the first main channel segment is located closer to the top end of the wellhead housing body compared to the distal end of the first main channel segment, and wherein the distal end of the first main channel segment is located closer to the bottom end of the wellhead housing body compared to the proximal end of the first main channel segment; and a first auxiliary channel segment that traverses the wellhead housing body, wherein the first auxiliary channel segment has a proximal end at the outer perimeter of the wellhead housing body and a distal end at the inner perimeter of the wellhead housing body;

an additional wellhead component disposed within the wellhead housing cavity of the wellhead housing, wherein the additional wellhead component comprises:

an additional wellhead component body having a top end, a bottom end, and an additional wellhead housing cavity that traverses its length between the top end and the bottom end, wherein the annulus is within the additional wellhead housing cavity;

a second main channel segment of the main channel, wherein the second main channel segment traverses the additional wellhead housing body, wherein the second main channel segment has a distal end at the annulus and a proximal end at an outer perimeter of the additional wellhead housing body, wherein the proximal end of the second main channel segment is located closer to the top end of the additional wellhead housing body compared to the distal end of the second main channel segment, wherein the distal end of the second main channel segment is located closer to the bottom end of the additional wellhead housing body compared to the proximal end of the second main channel segment, and wherein the proximal end of the second main channel segment merges and is continuous with the distal end of the first main channel segment; and a second auxiliary channel segment that traverses the additional wellhead component body, wherein the second auxiliary channel segment has a proximal end at the outer perimeter of the additional wellhead component body and a distal end at the inner perimeter of the additional wellhead component body, wherein the distal end is in communication with the annulus, and wherein the proximal end of the second auxiliary channel segment merges and is continuous with the distal end of the first auxiliary channel segment;

tubing disposed in the first main channel segment and the second main channel segment, wherein a distal end of the tubing is in the annulus, and wherein a proximal end of the tubing is connected to a liquid collection system; and piping coupled to the first auxiliary channel segment, wherein a proximal end of the piping is connected to a fluid injection system.

6. The system of claim 5, wherein the wellhead housing is positioned within a cellar.

7. The system of claim 5, wherein the distal end of the tubing is disposed in the liquid within the annulus.

8. The system of claim 5, wherein the fluid injection system is configured to inject a fluid into the annulus to force the liquid out of the annulus through the tubing.

9. The system of claim 5, wherein the tubing is disposed in the first main channel segment and the second main channel segment when a pressure within the annulus reaches a threshold value.

10. The system of claim 5, further comprising:

a sensor device configured to measure the pressure within the annulus.

11. The system of claim 5, wherein the liquid collection system draws the liquid out of the annulus through the tubing.

12. The system of claim 5, wherein the additional wellhead component comprises a casing hanger.

13. A method for removing liquid from an annulus in a wellbore, the method comprising:

inserting tubing through a main channel in a wellhead housing, wherein a distal end of the tubing is disposed in the liquid in the annulus formed between a tubing string and a casing string, and wherein the main channel forms an obtuse angle with an outer surface of the wellhead housing;

inserting piping into an auxiliary channel the wellhead housing, wherein a distal end of the auxiliary channel is disposed in the annulus;

injecting a fluid into the annulus through the piping, wherein the fluid forces the liquid up the annulus toward the tubing; and removing the liquid from the annulus through the tubing.

14. The method of claim 13, wherein the liquid is removed from the annulus through the tubing using a liquid collection system.

15. The method of claim 13, further comprising:

determining that a pressure within the annulus exceeds a threshold value before inserting the tubing through the main channel.

16. The method of claim 13, further comprising:

operating a fluid injection system to inject the fluid into the annulus through the piping disposed in the auxiliary channel in the wellhead housing, wherein the fluid is pressurized and forces the liquid upward within the annulus.

17. The method of claim 13, wherein the tubing remains in the main channel during a majority of a production operation of the wellbore.

18. The wellhead housing of claim 1, wherein the body is configured to be located outside of water.

19. The wellhead housing of claim 1, wherein the auxiliary channel comprises a coupling feature at its proximal end, and wherein the coupling feature is configured to couple to a distal end of the piping.

* * * * *